United States Patent [19]

Josenhans

[11] Patent Number: 4,678,221

[45] Date of Patent: Jul. 7, 1987

[54] CARRYING HANDLE FOR TWO BOTTLES HAVING BUILT IN CARRYING LIPS

[76] Inventor: Frederick G. Josenhans, 14020 Netherfield Dr., Midlothian, Va. 23113

[21] Appl. No.: 804,525

[22] Filed: Dec. 4, 1985

[51] Int. Cl.[4] ..... B65D 23/10; B65D 71/00

[52] U.S. Cl. ..... 294/170; 206/150; 294/31.2; 294/87.2

[58] Field of Search ..... 294/27.1, 31.2, 33, 294/87.1, 87.2–87.28, 137, 143, 148–150, 153–156, 159, 162–167, 170, 171; 206/145, 150, 151, 162, 167, 169; 215/100 A

[56] References Cited

U.S. PATENT DOCUMENTS

| | | | |
|---|---|---|---|
| 971,876 | 10/1910 | Apple | 294/170 X |
| 1,035,088 | 8/1912 | High | 294/33 |
| 2,409,357 | 10/1946 | Jackson | 294/87.2 |
| 2,611,639 | 9/1952 | Sadeck | 294/87.2 |
| 2,809,861 | 10/1957 | Socke | 294/31.2 X |
| 3,297,220 | 1/1967 | Leeberg | 294/170 X |

FOREIGN PATENT DOCUMENTS

| | | | |
|---|---|---|---|
| 599188 | 5/1960 | Canada | 294/87.2 |
| A80494 | 3/1963 | France | 294/87.2 |
| 266172 | 7/1929 | Italy | 294/142 |
| 128654 | 6/1950 | Sweden | 294/166 |

*Primary Examiner*—Johnny D. Cherry
*Attorney, Agent, or Firm*—Norman B. Rainer

[57] ABSTRACT

A carrying handle for two beverage containers of the type having a molded in carrying lip, the handle being comprised of a length of rigid tubing threaded with an endless loop of essentially nonstretching cord each end of which is available to be secured about one bottle neck below the carrying lip.

2 Claims, 4 Drawing Figures

CARRYING HANDLE FOR TWO BOTTLES HAVING BUILT IN CARRYING LIPS

BACKGROUND OF THE INVENTION

For as long as mankind has had occasion to carry items he has sought handles as a means of easing this task, and/or to provide an increased degree of safety in doing so. These handles have been of both permanent type, as on a coffee cup, or removeable as Rais U.S. Pat. No. 4,486,043 "Reuseable handle for plastic bottle", Doucette U.S. Pat. No. 3,682,352 "Detachable handle for beer can" or Newman U.S. Pat. No. 4,231,605 "carrier assembly for multiple containers".

In the evolution of blow molded plastic containers for soft drinks a carrying lip was molded into the neck to facilitate carrying. This is convenient for short distances, and one may carry two of the two liter capacity size, again for a short distance as carrying for more than a few minuts becomes uncomfortable even to the point of causing cramps in the fingers.

SUMMARY OF THE INVENTION

The present invention consists of a relatively rigid tube of comfortable diameter and at leat long enough for carrying comfortably in one hand, into which has been inserted an essemtially nonstretching endless cord such that a loop of cord exists at each end of the tube. The tube may be longer to allow the bottles to hang freely.

The assembly is easily assembled to the bottles. One loop of the cord is placed about the neck of the first bottle, below the carrying lip. The other loop is pulled, thus tightening the first loop to the first bottle, at the same time the tube is slid against either the first bottles neck below the lip, or against the lip itself. The second loop at this time is not large enough to allow the entire lip to pass through at the same time. The second loop is therefor placed over the head and then worked incrementally over the entire lip of the second bottle. A loose ring on the loop may be employed to facilitate this operation. With both loops below the lips of their respective bottles the assembly is complete and the bottles may be carried. When the tube is lifted the cord is drawn tight and its loops pulled tightly against the bottle's necks, and tightly against the lips where the loops enter the tube. The periphery of the lip exerts a pair of forces on the cord tending to open the loop until the bottle woudl fall out of the loop. These forces are countered by equal forces imposed by the end of the tube, thus preventing the bottles excape. Tests have shown that the device is secure not only in carrying, but through severe jerking up and down on the handle, as to free itself the cord would have to pull tight against one bottle and serpentine itself over the neck of the other.

Disassembly of the unit is quickly accomplished, with the bottles set upon a surface. One loop is pulled to tighten the other and the tube pushed toward the tightened loop. The pulled loop is incrementally worked over the bottle lip, then off its bottle, released, and the other loop may easily be removed from its bottle.

The length of the endless cord when flattened or the cord's one time path length must be within a definite range long enough to allow for assembling the device to the bottles at one extreme, and short enough to prevent accidental disassembly during carrying. These length limits are determined by the length of the tube, the diameter of the tube, the neck diameter of the bottle just below its carrying lip, the diameter of the carrying lip, and the diameter as well as type of cord.

A formula was developed toward defining the limits, and the optimum cord length for any combination of the aforesaid factors. This was discarded principally due to the enumerable cords that might be used ranging from essentially nonstretching nylon single strand cord through very loose weave braided polyethlene rope, therefore the limits remain defined as above, and trial and error is used to determine the length used in each case.

BRIEF dESCRIPTION OF THE DRAWING

For a fuller understanding of the nature and objects of the invention, reference should be had to the following detailed description taken in connection with the accompanying drawing forming a part of this specification and in which similar numberals of reference indicate corresponding parts in all the figures of the drawing.

DESCRIPTION OF THE PREFERRED EMBODIMENT

Figure 1:
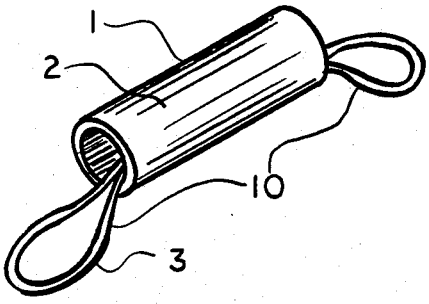
FIG. 1 is a perspective view of an embodiment of the device of the present invention.
Figure 2:
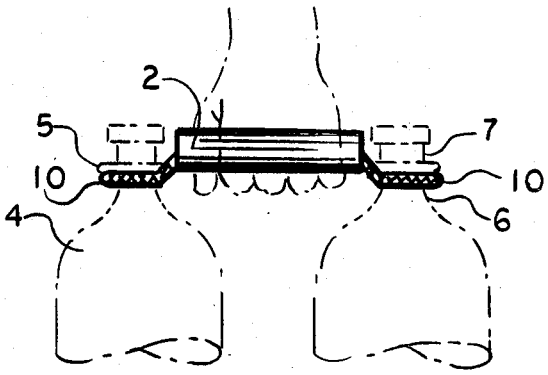
FIG. 2 shows the device of FIG. 1 in operative association with two beverage bottles having identical annular carrying flanges.

Referring now to the drawings, FIG. 1 is a view of the device 1 comprised of a tube 2 of reasonably stiff material in which is located an endless nonextendable cord 3 such that loops 10 extend from each end of the tube. FIG. 2 shows the device 1 in use to transport two plastic bottles 4 of the type having a carrying lip 5 of a diameter larger than and located above a neck 6 of the bottle. The cord is shown with its loops 10 positioned below the carrying lips and pulled taut thru the tube by the weight of the bottles, the loops being restrained from enlarging and slipping over the lip by the forces imposed by the inner wall of the ends of the tube.

Figure 3:
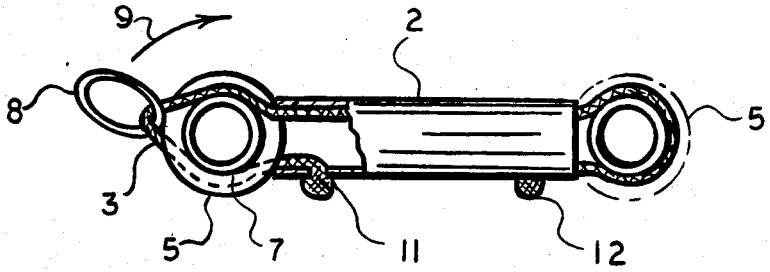
FIG. 3 is a top view of the device of FIG. 2 with portions broken away to reveal interior detail.

FIG. 3 is a top view showing one combination of relative sizes of tube shown in partial cross section, bottle neck 7 and lip, and cord, at one point during assembly. In this drawing the "endless cord" is actually a certain length of cord with its ends 12 secured in holes 11 in the tube such that the portion of the tube between the holes completes the endless nature of the cord. One loop has previously been placed around the right side bottles neck, below the phantom lip. The other loop has been pulled away from the tube as far as possible, placed over the upper bottle neck 7, and then worked under the lip beginning with one side of the loop adjacent to the tube and progressing around the lip until the entire loop is below. This operation is shown approximately sixty percent complete in the drawing, which also shows an optional ring 8 which can facilitate placement of the loop, traveling in this case in a clockwise direction 9. Removal of the device is by reversing the operations just described for FIG. 3.

Figure 4:
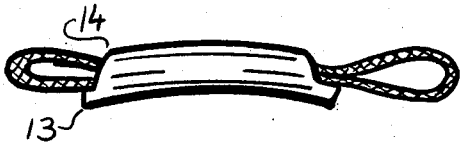
FIG. 4 is a side view of an alternative embodiment of the device.

FIG. 4 is a side view of a variation of the device embodying two of many possible variations to a square cut tube. The bevel 14 allows easier assembly of the device to the bottles by having the tube's short side facing the bottle tops while placing the cord, then rotating it to the position shown for carrying. Lips 13 may be incorporated in the tube ends to fit under the bottle lips 5.

I claim:

1. An assembly comprising:

(a) two beverage bottles of plastic construction in adjacent upright disposition having identical annular carrying flanges extending outwardly from a narrow neck, and (b) a device removably securing said bottles for the carrying thereof, sadi device comprising:

(1) a substantially rigid tube handle having two opposed open extremities, and (2) a substantially non-elongatable cord positioned within and extending the entire length of said tube handle and protruding from each open extremity thereof as a loop whose size is self-adjusting by virtue of movement of the cord axially within said tube handle between said extremities to cause equal but opposite size change in the opposite loop, the length of said cord relative to the length of said tube handle being such that when one of said loops is in tight-fitting contact with the neck of one bottle, the opposite loop has a size adequate to make tight-fitting passage over the carrying flange of the other bottle but smaller than the circumference of the flange, (c) the extremities of said handle being positioned closely adjacent the flanges of said bottles.

2. A device for removably securing and carrying two beverage bottles having identical annular carrying flanges which extend outwardly from a narrow neck, said device comprising:

(a) a substantially rigid tube handle having two opposed extremities, and two apertures in the wall of said tube handle, and (b) a substantially non-elongatable cord positioned within and extending the entire length of said tube handle and protruding from each extremity as a loop whose size is self-adjusting by virtue of movement of the cord axially within said tube handle between said extremities to cause equal but opposite size change in the opposite loop, the length of said cord relative to the length of said tube handle being such that when one of said loops is in tight-fitting contact with the neck of one bottle below its flange, the size of the opposite loop is adequate to make tight-fitting passage over the carrying flange of the other bottle, said cord having two ends, each end passing from the interior of said tube handle to the exterior thereof through one of said apertures and being anchored upon the exterior of said tube handle.

* * * * *